US007761020B2

(12) United States Patent
Toizumi et al.

(10) Patent No.: US 7,761,020 B2
(45) Date of Patent: Jul. 20, 2010

(54) IMAGE FORMING APPARATUS UTILIZING CYLINDRICAL TONER PARTICLES

(75) Inventors: Kiyoshi Toizumi, Nara (JP); Rika Hayashi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 244 days.

(21) Appl. No.: 12/000,444

(22) Filed: Dec. 12, 2007

(65) Prior Publication Data

US 2008/0145084 A1 Jun. 19, 2008

(30) Foreign Application Priority Data

Dec. 13, 2006 (JP) ..... 2006-336287
Nov. 30, 2007 (JP) ..... 2007-311630

(51) Int. Cl.
*G03G 15/16* (2006.01)
*G03G 15/00* (2006.01)
*G03G 15/08* (2006.01)
*G03G 15/20* (2006.01)

(52) U.S. Cl. ..... 399/66; 399/167; 399/252; 399/314

(58) Field of Classification Search ..... 399/66, 399/167, 252, 297, 299, 314
See application file for complete search history.

(56) References Cited

U.S. PATENT DOCUMENTS 5,159,393 A 10/1992 Hiroshima et al.
5,415,966 A * 5/1995 Matsuura ..... 399/314 X
5,515,154 A 5/1996 Hasegawa et al.
5,633,703 A * 5/1997 Takenouchi et al. ..... 399/66 X
6,226,465 B1 * 5/2001 Funatani ..... 399/6 X
6,944,418 B2 * 9/2005 Tamaoki ..... 399/297
6,990,304 B2 * 1/2006 Mitamura et al. ..... 399/167
2006/0210327 A1 9/2006 Iwakura et al.

FOREIGN PATENT DOCUMENTS

JP 3-155584 A 7/1991
JP 4-86878 3/1992
JP 7-271201 10/1995
JP 2000-122442 4/2000
JP 2001-51468 2/2001
JP 2003-149955 5/2003
JP 2004-29435 A 1/2004
JP 2004-279638 A 10/2004
JP 2006-106236 4/2006
JP 2006-259639 A 9/2006
JP 2006-293160 A 10/2006
JP 2006-301332 A 11/2006
JP 2007-41496 A 2/2007

* cited by examiner

*Primary Examiner*—Sandra L Brase
(74) *Attorney, Agent, or Firm*—Nixon & Vanderhye, PC

(57) ABSTRACT

In an image forming apparatus in which a visual image on a photosensitive drum is developed with columnar toner, and the developed toner image is transferred from the photosensitive drum to an intermediate transfer belt, a moving speed of the photosensitive drum and a moving speed of the intermediate transfer belt are different at a contact position (transfer nip section) where the photosensitive drum and the intermediate transfer belt are in contact. With this arrangement, toner scattering, nonuniform image etc. can be reduced in the image forming apparatus, in which the development is carried out with columnar toner.

14 Claims, 8 Drawing Sheets

IMAGE FORMING APPARATUS UTILIZING CYLINDRICAL TONER PARTICLES

This Nonprovisional application claims priority under 35 U.S.C. §119(a) on Patent Applications No. 336287/2006 filed in Japan on Dec. 13, 2006, and No. 311630/2007, filed in Japan on Nov. 30, 2007, the entire contents of which are hereby incorporated by reference.

FIELD OF THE TECHNOLOGY

The present technology relates to an electrophotographic image forming apparatus, especially to an image forming apparatus, which performs development with columnar toner.

BACKGROUND OF THE TECHNOLOGY

An image forming apparatus using columnar toner has been proposed conventionally. The columnar toner is advantageous in that the toner has uniform diameter easily, the toner can be produced with a high yield, and the toner forms an image with even thickness easily. With these advantageous properties, the columnar toner is expected to attain (a) stable image density, (b) better control over color density (gradation), (c) higher resolution, (d) prevention of photographic fog and or prevention of dusts (dots in white space) in transferring, (e) prevention of filming a developing roller or photoreceptor with toner particles, and the other effects.

For example, Patent Document 1 (Japanese Patent Application Publication, Tokukai, No. 2006-106236 (published on Apr. 20, 2006) discloses an art of producing columnar toner particles, the art including extruding a molten toner material into a fiber shape via a nozzle, cutting the fiber-shaped toner material thereby forming cylindrical particles, binding an external additive to surfaces of the cylindrical particles by applying a mechanical force on a mixture of the cylindrical particle and the external additive, and chamfering edges of the cylindrical particles.

Patent Document 2 (Japanese Patent Application Publication, Tokukai, No. 2000-122442 (published on Apr. 28, 2000) discloses an art in which a rotating rate of a transfer-giving (member from which the toner image is transferred) is slightly faster than that of an image transfer body (member for receiving the transfer), or a moving speed of a recording medium. In a conventional electrophotographic image forming apparatus, this art makes it easy to remove toner particles from the transferring-giving member.

Patent Document 3 (Japanese Patent Application Publication, Tokukai, No. 2003-149955 (published on May 21, 2003) discloses an art for improving resolution in a sub-scanning direction. In the art, an electrostatic latent image pattern is formed on a surface of an electrostatic latent image bearing member, the electrostatic latent image pattern being extended along the sub-scanning direction at an A/B ratio with respect to an original image pattern, and the electrostatic latent image bearing member being rotated at a speed of Vopc, which is faster than a device process speed Vpro (Vopc is faster than Vpro by B/A times). Then, the extended electrostatic latent image pattern is visualized by developing means. The visualized image is transferred to an intermediate transfer body rotating at the device process speed Vpro, thereby forming an image pattern in a desired size.

Moreover, Patent Document 4 (Japanese Patent Application Publication, Tokukaihei, No. 4-86878 (published on Mar. 19, 1992) discloses an art for preventing toner coagulation between a transfer nip thereby attaining good-quality printing free from blank of a line or a character in a recording apparatus having an image bearing member for forming a toner image thereon and, transfer means for transferring a toner image to a toner image receiving member from the image bearing member. The toner coagulation is prevented by applying an AC transfer bias of a frequency that satisfies Fr 4000 and $(Fr \times d)/V \leqq Fr(Hz)$ where Fr(Hz) is a frequency of an AC bias, d (mm) is a nip distance between the transfer means and the image bearing member, and V(mm/sec) is a moving speed of the image bearing member.

In such an image forming apparatus using the cylinder toner, the image is formed with toner particles whose longitudinal directions are oriented randomly in various directions including a main scanning direction and the sub scanning direction. This would result in inconsistency of density due to spaces formed between the randomly-oriented toner particles, or would cause scattering of the toner particles.

FIG. 7 is an explanatory view schematically illustrating how a toner image developed on a photosensitive drum 101 is transferred to an intermediate transfer belt 102 in an image forming apparatus using conventional columnar toner. As illustrated in FIG. 7, the intermediate transfer belt 102 is pressed against the photosensitive drum 101 by a transfer roller 103, thereby forming a transfer nip section, at which the toner image is transferred from the photosensitive drum 101 to the intermediate transfer belt 102. In the image forming apparatus using the conventional columnar toner, the photoreceptor drum 101 and the intermediate transfer belt 102 are rotated at such speeds that they move at equal velocity at the nip position where they are in contact with each other.

As illustrated in FIG. 7, the toner image developed on the photosensitive drum 101 is formed from toners whose longitudinal directions are randomly oriented. This cases gaps between toner particles within a dot (between the toner particles contributing the image formation). Thus, the toner particles cannot stably in touch with each other. This would cause scattering of toner before fixation, or inconsistency of density after the fixation.

The arts disclosed in Patent Documents 2 and 3 are expected to be effective to easily remove the toner particles from the member from which the toner image is to be transferred. However, they do not consider the use of the columnar toner and cannot enjoy the advantages (a) to (e) provided by the use of the columnar toner in the image forming apparatus.

Moreover, the art disclosed in Patent Document 4 is expected to be effective in preventing blank of lines or characters during the image transfer. However, it does not consider the use of the columnar toner and cannot enjoy the advantages (a) to (e) provided by the use of the columnar toner in the image forming apparatus.

SUMMARY OF THE TECHNOLOGY

The present technology is accomplished in view of the aforementioned problem. An object of the present technology is to prevent toner scattering and image inconsistency in an image forming apparatus in which development is carried out with columnar toner.

In order to attain the object, the present technology includes: an image bearing member; first driving means for rotating the image bearing member; electrical charging means for electrically charging the image bearing member; latent image forming means for forming an electrostatic latent image on the electrically charged image bearing member; developing means for developing the latent image formed on the image bearing member, to form a toner image with columnar toner whose shape is stretched in one direction; second driving means for effecting relative movement of an image transfer body with respect to the image bearing member; and transfer means for transferring the toner image from the image bearing member to the image transfer body by contacting the image bearing member with the image transfer body, the image bearing member and the image transfer body having different moving speeds at a contact position where they are in contact with each other.

With this arrangement, in which the image bearing member and the image transfer body have different moving speeds at a contact position where they are in contact with each other, a rubbing force is caused between the image bearing member and the image transfer body. The rubbing force orients longitudinal directions of particles of the columnar toner along the main scanning direction (a direction vertical to a rotation direction). This allows the toner particles to attach with each other with a greater contact area, thereby attaining a greater coagulation between the toner particles. This prevents the toner scattering. Moreover, this prevents gap formation between the toner particles. This prevents density inconsistency in a transferred toner image.

The use of the columnar toner provides (a) stable image density, (b) better control over color density (gradation), (c) higher resolution, (d) prevention of photographic fog and or prevention of dusts (dots in white space) in transferring, (e) prevention of filming a developing roller or photoreceptor with toner particles, and the other effects.

The image transfer body may be a recording medium in a sheet shape, or an intermediate transfer body, to which the toner image is transferred from the image bearing member and from which the toner image is transferred to a recording medium in a sheet-like shape. The recording medium in a sheet shape may be a thin-film recording medium such as paper or a transparent film, for example.

Additional objects, features, and strengths of the present technology will be made clear by the description below. Further, the advantages will be evident from the following explanation in reference to the drawings.

DESCRIPTION OF THE EMBODIMENTS

One embodiment of the present technology is described below.

Figure 2:
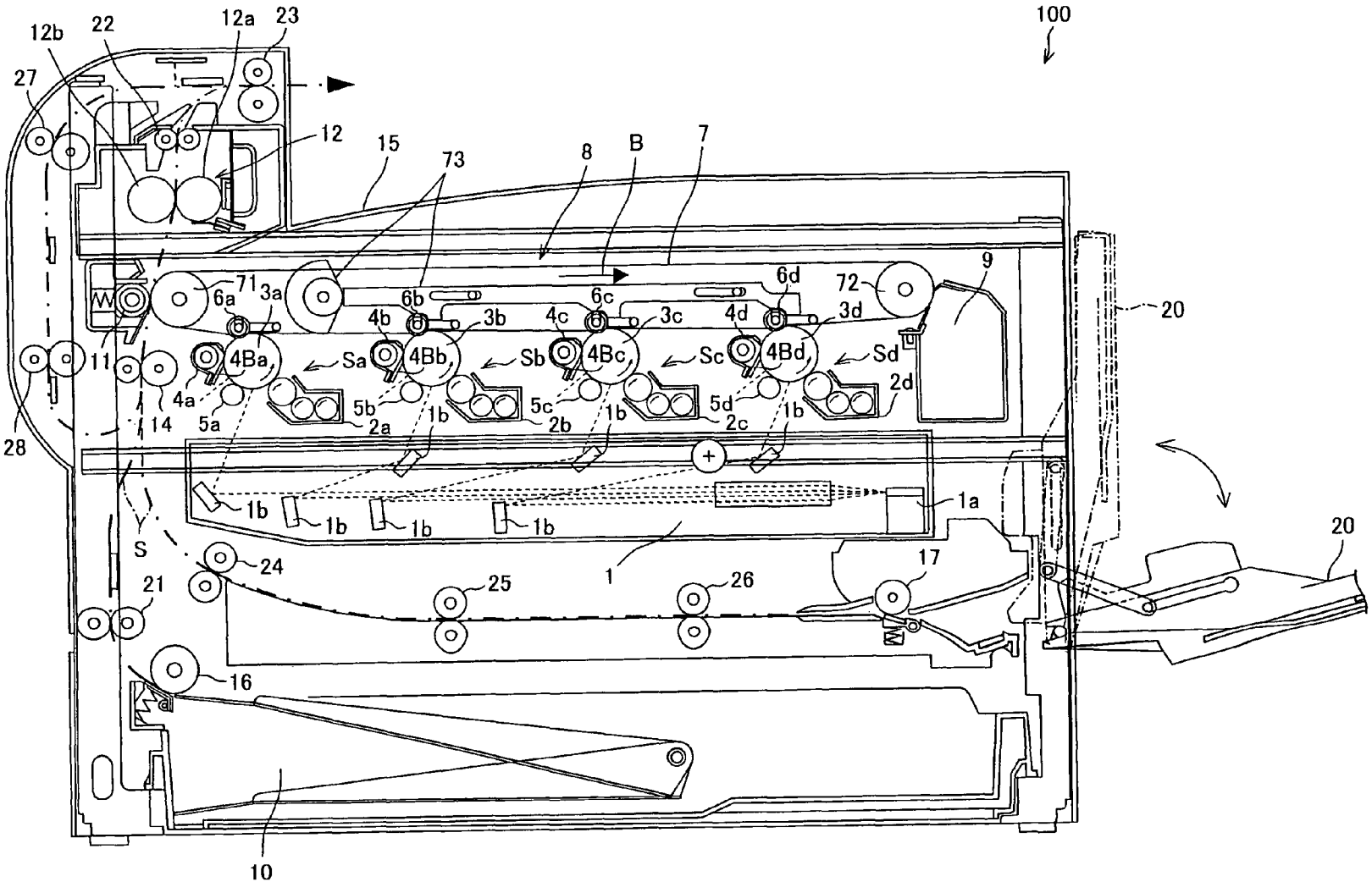
FIG. 2 is a cross sectional view schematically illustrating a structure of an image forming apparatus.

FIG. 2 is a cross sectional view schematically illustrating a structure of an image forming apparatus 100 according to the present embodiment. The image forming apparatus 100 is an image forming apparatus of color tandem engine type, which forms an image in one or more colors on a recording sheet (sheet), based on an image data transmitted thereto from outside.

As illustrated in FIG. 2, an image forming apparatus 100 includes a light exposing unit 1, developing units 2*a* to 2*d*, photosensitive drums 3*a* to 3*d*, electrical charging units 5*a* to 5*d*, cleaner units 4*a* to 4*d*, an image transfer belt 7, an image transfer belt unit 8, a fixing unit 12, a sheet transport path S, a sheet feeding tray 10, a sheet output tray 15, and the other members. Operations of each member provided in the image forming apparatus 100 is controlled by a CPU (control section; not illustrated).

Image data handled in the image forming apparatus 100 is for a color image formed with black (K), cyan (C), magenta (M), and yellow (Y). Therefore, as illustrated in FIG. 2, the developing units 2*a* to 2*d*, photosensitive drums 3*a* to 3*d*, electrical charging units 5*a* to 5*d*, and cleaner units 4*a* to 4*d* are provided respectively to form four types of latent images in the respective colors (K, C, M, and Y). With those members, four image stations Sa, Sb, Sc, and Sd are respectively formed for the colors (K, C, M, and Y). In the reference numerals, "a" is for black, "b" is for cyan, "c" is for magenta, and "d" is for yellow. Furthermore, the image stations Sa to Sd are substantially identical with each other structurally The photosensitive drums 3*a* to 3*d* are provided in an upper portion of the image forming apparatus 100. Around each of the photosensitive drums 3*a* to 3*d*, the electrical charging units 5*a* to 5*d*, the developing units 2*a* to 2*d*, and cleaner units 4*a* to 4*d* are respectively provided along a rotation direction of the photosensitive drums 3*a* to 3*d* (along the arrow direction shown in FIG. 2). How to control the rotation of the photosensitive drums 3*a* to 3*d* will be described later.

The electrical charging units 5*a* to 5*d* are means for electrifying surfaces of the electrical charging units 5*a* to 5*d* uniformly at a predetermined potential. The electrical charging units 5*a* to 5*d* may have any structure. For example, the electrical charging units 5*a* to 5*d* may be of non-contact type such as corona discharging method, or of contact type such as roller electrification or brush electrification.

According to image data inputted thereto, the light exposing unit 1 applies light on the photosensitive drums 3*a* to 3*d* that is electrified by the electrical charging units 5*a* to 5*d*. Thereby, the light exposing unit 1 has a function of forming an electrostatic latent image on the surfaces of the photosensitive drums 3*a* to 3*d* according to the image data. In this embodiment, the light exposing unit 1 is a laser scanning unit (LSU), which includes a laser radiating section 1*a*, a reflection mirror 1*b*, and the like. Moreover, the light exposing unit 1 may be a writing head (EL writing heat or LED writing head) in which light emitting elements are arrayed.

The developing units 2*a* to 2*d* performs developing operation of the electrostatic latent image formed on the photosensitive drums 3*a* to 3*d* respectively, thereby to visualize the latent image in corresponding colors (K, C, M, and Y).

In the present embodiment, the development operation is carried out with circular columnar toner (columnar toner, non-spherical toner). In this Specification, what is meant by the term "columnar toner" is toner extended in one direction. What is meant by the term "circular columnar toner" is a columnar toner which has a substantially symmetry along its axis (major axis) extended in the one direction. The columnar toner is not required to be axial symmetric strictly. Along as its cross section vertical to the axis is substantially circular, the columnar toner may have any cross sectional shape such as a circular cross sectional shape or ellipsoidal cross section shape. Moreover, the columnar toner may not have ends that are vertical to the axis. Moreover, surfaces of the ends is not limited to flat surface (e.g., they may be rough surfaces).

Moreover, in the present embodiment, the columnar toner has a L/D ratio of not less than 1 but not more than 3, where L is its length along the longitudinal direction and D is a diameter of the cross section vertical to the longitudinal axis. That is, the columnar toner has a L/R ratio of not less than 1.75 but not more than 3.63, where L is its length along the longitudinal direction and R is a radius of a sphere equal to the columnar toner in volume.

The cleaner units 4*a* to 4*d* includes cleaner blades 4Ba to 4Bd. With the cleaner blades 4Ba to 4Bd abutted against the photosensitive drums 3*a* to 3*d* respectively, toner remained on the photosensitive drums 3*a* to 3*d* after the development and image transfer is removed and collected therefrom.

The intermediate transfer belt unit 8 is arranged such that the toner images formed on the photosensitive drums 3*a* to 3*d* are transferred onto the intermediate transfer belt 7, superimposing them on each other sequentially so as to form a color toner image (multicolor toner image) thereon. The toner image formed on the intermediate transfer belt 7 is transported to a nip position between the recording sheet and the intermediate transfer belt 7 by rotation of the intermediate transfer belt 7 by the intermediate transfer belt unit 8. By the transfer roller 11 located at the nip position, the color toner image is transferred onto the recording sheet.

As illustrated in FIG. 2, the intermediate transfer belt unit 8 includes intermediate transfer rollers (transfer members) 6*a* to 6*d*, the intermediate transfer belt 7, an intermediate transfer belt driving roller 71, an intermediate transfer belt driven roller 72, an intermediate transfer belt tension mechanism 73, and an intermediate transfer belt cleaning unit 9. The intermediate transfer belt driven roller 72, the intermediate transfer belt tension mechanism 73, and the like are for rotating the intermediate transfer belt 7 in the direction of Arrow B with tension. How to rotate the intermediate transfer belt 7 will be described later.

On the intermediate transfer belt 7, the toner images formed on the photosensitive drums 3*a* to 3*d* are transferred onto the intermediate transfer belt 7, superimposing them on each other sequentially. Thereby, a color toner image (multicolor toner image) is formed on the intermediate transfer belt 7. The intermediate transfer belt 7 is an endless belt formed form a film of approximately 100 μm to 150 μm in thickness.

Moreover, the intermediate transfer belt 7 is detachable from the photosensitive drums 3*b* to 3*d*. That is, the intermediate transfer belt unit 8 is configured such that the intermediate transfer belt 7 can be detached from the photosensitive drums 3*b* to 3*d* by shifting relative positions of the intermediate transfer rollers 6*b* to 6*d*, the intermediate transfer belt driving roller 71, the intermediate transfer belt driven roller 72, and the intermediate transfer belt tension mechanism 73, and the like by driving means (not illustrated). This is to perform the monochromatic printing with the photosensitive drum 3*a* of black (k) solely touched with the intermediate transfer belt 7.

The transfer of the toner image from the photosensitive drums 3*a* to 3*d* to the intermediate transfer belt 7 is carried out with the intermediate transfer rollers 6*a* to 6*d* touching the intermediate transfer belt 7 from its reverse side. The intermediate transfer rollers 6*a* to 6*d* are rotatably supported by intermediate transfer roller mounting sections (not illustrated) of the intermediate transfer belt tension mechanism 73. The intermediate transfer rollers 6*a* to 6*d* apply a high-voltage transfer bias on the intermediate transfer belt 7, thereby to transfer the toner images from the photosensitive drums 3*a* to 3*d* to the intermediate transfer belt 7 respectively. The transfer bias is a high voltage of the opposite polarity (+) to the electrification polarity (−) of the toner.

Each of the intermediate transfer rollers 6*a* to 6*d* is positioned to abut against the corresponding photosensitive drum 3*a* to 3*d* with the intermediate transfer belt 7 therebetween. The abutting points of the intermediate transfer rollers 6*a* to 6*d* are respectively in the downstream of an intersection of each corresponding photosensitive drum with a tangent line of the photosensitive drum, which is parallel to the moving direction of the intermediate transfer belt 7.

The intermediate transfer rollers 6*a* to 6*d* has a metal shaft of 8 to 10 mm in diameter (e.g., made of stainless metal), and coated with an electrically conductive elastic material (e.g., EPDM urethane foam, or the like) on their surface. The electrically conductive elastic material makes it possible for the intermediate transfer rollers 6*a* to 6*d* to apply the high voltage on the intermediate transfer belt 7 evenly. In this exemplary embodiment, the intermediate transfer rollers 6*a* to 6*d* are transfer electrodes. However, the intermediate transfer rollers 6*a* to 6*d* may have another structure such as brush.

As described above, the electrostatic images (toner images) visualized in the respective colors on the photosensitive drums 3*a* to 3*d* are transferred (superimposed on each other) onto the intermediate transfer belt 7, thereby forming an image based on the image data inputted in the apparatus. After that, the transferred (superimposed) image is conveyed to the nip position between the recording sheet and the intermediate transfer belt 7 by the rotation of the intermediate transfer belt 7. Then, the image is transferred onto the recording sheet by the transfer roller 11 positioned at the nip position.

In transferring the image onto the recording sheet, the intermediate transfer belt 7 and the transfer roller 11 are pressed against each other with a predetermined nip (with predetermined pressing pressure and a predetermined nip width), the voltage for transferring the toner onto the recording sheet is applied on the transfer roller 11. The voltage is a high voltage of the opposite polarity (+) of the electrification polarity of the toner. In order to provide the transfer roller 11 with the nip constantly, it is preferably arranged such that one of the transfer roller 11 and the intermediate transfer belt driving roller 71 be formed from a hard material (such as a metal or the like, and the other be formed from a soft material (e.g., an elastic roller or the like (such as an elastic rubber roller or foamed resin roller)).

Moreover, as described above, the toner attached on the intermediate transfer belt 7 by contacting the intermediate transfer belt 7 with the photosensitive drum 3*a* to 3*d*, or the toner not transferred to the recording sheet by the transfer roller 11 and remained on the intermediate transfer belt 7 would cause color mixing of the toner in the following printing process. Therefore, it is arranged such that such toner is removed and collected by the intermediate transfer belt cleaning unit 9.

The intermediate transfer belt cleaning unit 9 includes a member (cleaning member) that is in touch with the intermediate transfer belt 7. The cleaning member may be a cleaning blade, for example. In this arrangement, the intermediate transfer belt 7 is supported by the intermediate transfer belt driven roller from its reverse side at the position where the intermediate transfer belt 7 is in contact with the cleaning blade.

The sheet feeding tray 10 is a tray for storing the recording sheets (recording paper) for used in image formation. The sheet feeding tray 10 is provided under the light exposing unit 1 of the image forming apparatus 100. Moreover, the sheet output tray 15, which is provided above the image forming apparatus 100, keeps the printed recording sheet with its surface down. Furthermore, a manual sheet feeding tray 20 is provided on a side wall of the image forming apparatus 100 and is foldable. The manual sheet feeding tray 20 is a tray for manually feeding the recording sheet on the side of the image forming apparatus 100.

Moreover, the image forming apparatus 100 is provided with a sheet transport path S, which is substantially vertical. The sheet transport path S is for transporting the recording sheet from the sheet feeding tray 10 via the transfer roller (transfer section) 11 and the fixing unit 12 to the sheet output tray 15. Furthermore, in the vicinity of the sheet transport path S from the sheet feeding tray 10 and the manual sheet feeding tray 20 to the sheet output tray 15, pick-up rollers 16 and 17, a resist roller 14, the transfer roller 11, the fixing unit 12, the transport rollers 21 to 28 for transporting the recording sheet, and the other members are provided.

The transport rollers 21 to 26 are small rollers for use in facilitating and assisting the transport of the recording sheet, and provided along the sheet transport path S. The transport rollers 27 and 28 are rollers for transporting the recording sheets from a revere sheet output path (provided on a side of the fixing unit 12) of the sheet transport path S to the resist roller 14 in reversing a recording sheet on one side of which the image is transferred, so as to print on the other side of the recording sheet in both-side printing.

The pick-up roller 16 is provided at an outlet of the sheet feeding tray 10, while the pick-up roller 17 is provided at an outlet of the manual sheet feeding tray 20. The pick-up roller 16 is a roller for feeding the recording sheets to the sheet transport path S from the sheet feeding tray 10 one by one. The pick-up roller 17 is a roller for feeding the recording sheets to the sheet transport path S from the manual sheet feeding tray 20 one by one.

The resist roller 14 is a roller for temporally holding the recording sheet in transportation through the sheet transport path S. The resist roller 14 transports the recording sheet to the transfer roller 11 at such a timing that a front edge of the toner image of the intermediate transfer belt 7 matches with a front edge of the recording sheet.

The fixing unit 12 includes a heat roller 12*a*, and a pressure roller 12*b*. The heat roller 12*a* and the pressure roller 12*b* rotate with the recording sheet sandwiched therebetween.

Moreover, the heat roller 12*a* is controlled to have a predetermined fixing temperature under control based on a signal from a temperature detector (not illustrated). Working with the pressure roller 12*b*, the heat roller 12*a* applies heat and pressure on the recording sheet, whereby the toner image (multicolor toner image or monochrome toner image) transferred on the recording sheet is melted, mixed, and pressured against the recording sheet, thereby to be fixed on the recording sheet thermally.

Figure 1:
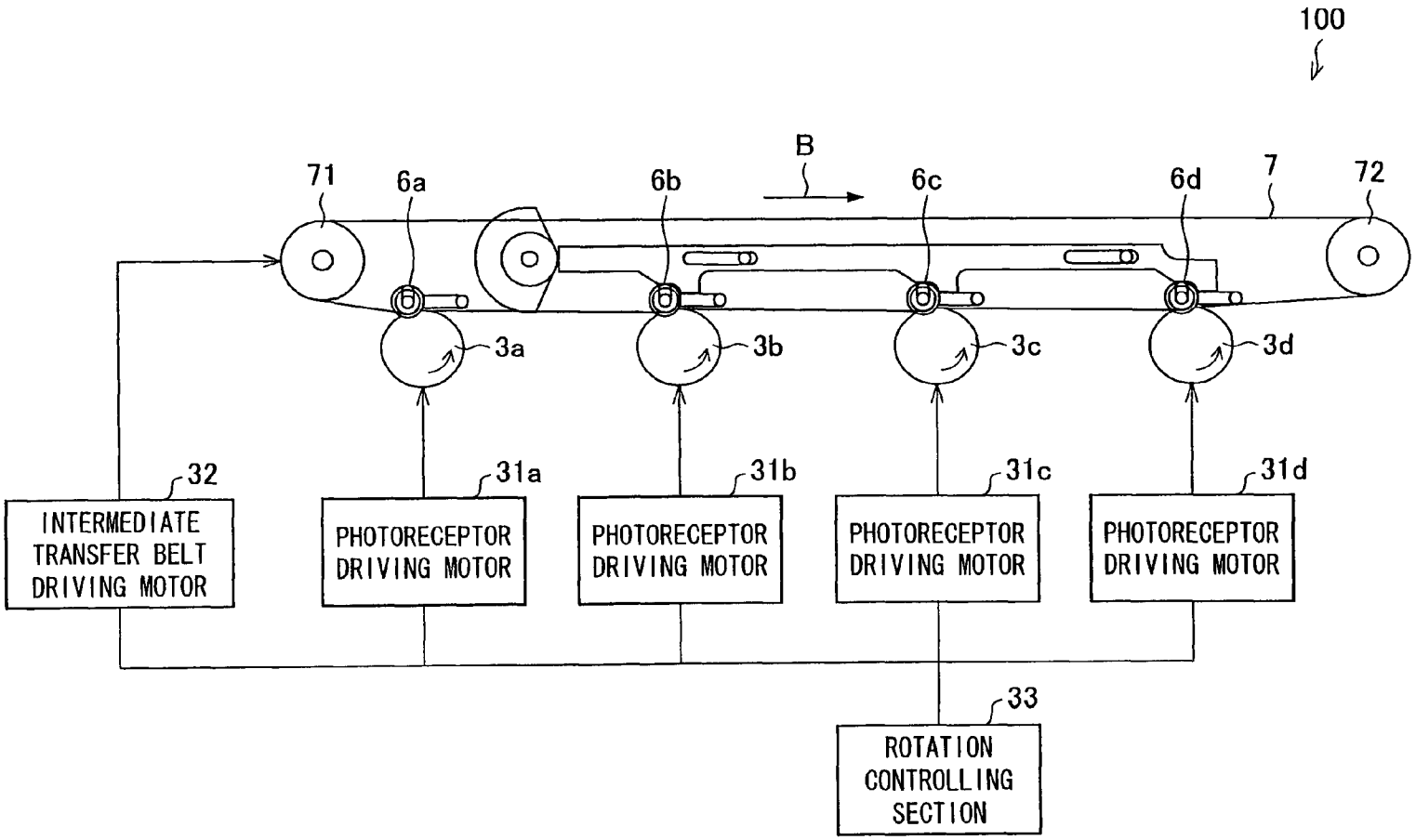
FIG. 1 is an explanatory view illustrating a rotation control mechanism for rotating a photosensitive drum and an intermediate transfer belt driving roller provided in an image forming apparatus.

Next, driving control of the photoreceptor driving motors 31*a* to 31*d* and the intermediate transfer belt driving motor 32 is described. FIG. 1 is an explanatory view for explaining a rotation control mechanism of the photosensitive drums 3*a* to 3*d* and the intermediate transfer belt driving roller 71. As illustrated in FIG. 1, the photosensitive drum 3*a* to 3*d*, and the intermediate transfer belt driving roller 71 are connected to driving motors (photoreceptor driving motors 31*a* to 31*d*, and intermediate transfer belt driving motor 32) respectively. A rotation control section 33 provided to the CPU (control section) supply control signals to the driving motors thereby to rotate them independently.

Figure 3:
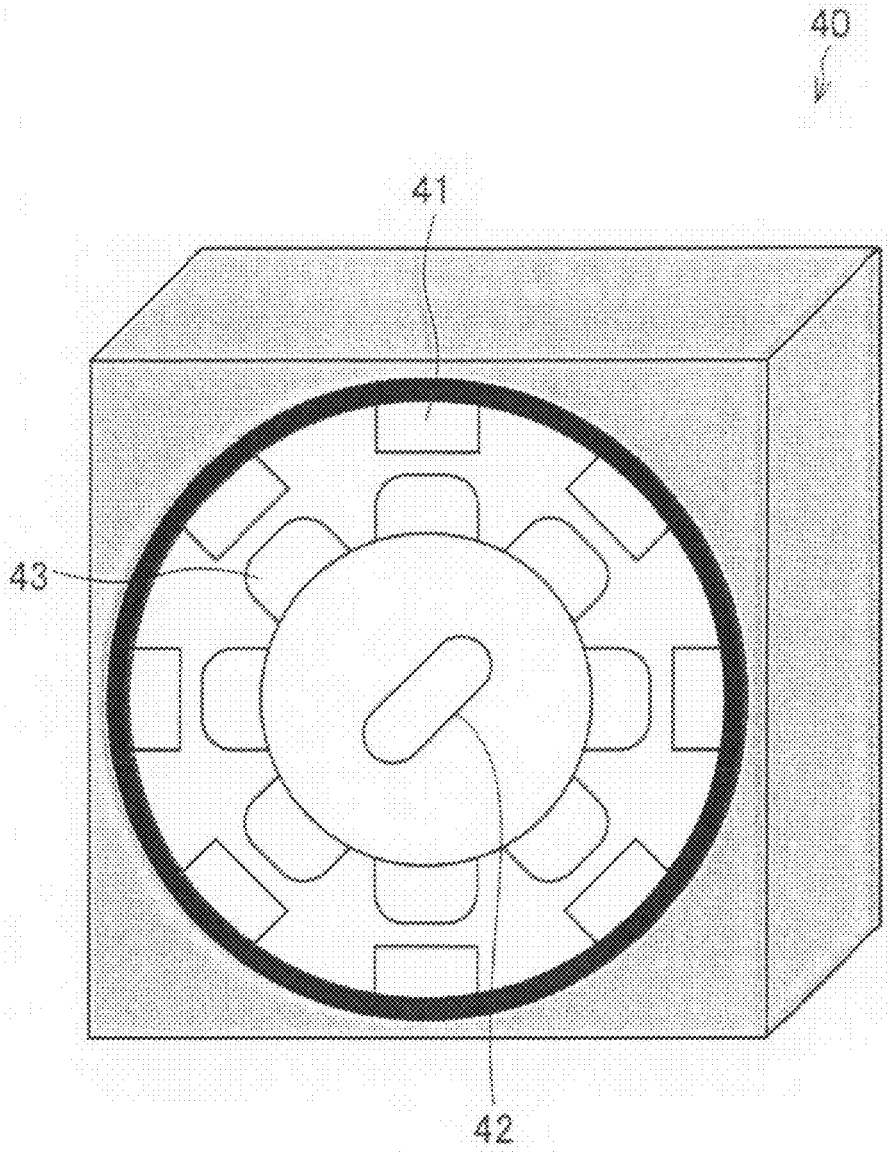
FIG. 3 is a cross sectional view illustrating one example of a photoreceptor driving motor and an intermediate transfer driving motor provided in the image forming apparatus.

The driving motors are not particularly limited, provided that theirs rotation speed can be controlled. For example, a stepping motor 40 as illustrated in FIG. 3 may be adopted as the driving motor. The stepping motor 40 illustrated in FIG. 3 includes stationary stators (electromagnets) 41, a rotation shaft (shaft) 42, and a rotors (magnetos) 43 attached to the rotation shaft 42. With this configuration, a magnetic force is generated by flowing a current through coils according to pulse frequency signals (control signals) inputted to the stepping motor 40, the coils being winded up around the stators 41. With the magnetic force, the rollers 43 are attracted and rotated. Thus, the rotation speed of the stepping motor 40 is sped up by shortening intervals of switching the excitation of the stators, and is sped down by prolonging the intervals of switching the excitation of the stators. That is, the rotation speed of the motor can be controlled by adjusting a frequency or duty ratio of the pulse frequency signal.

The rotation control section 33 sends the control signals to the photoreceptor driving motors 31*a* to 31*d* and the intermediate transfer belt driving motor 32 in order to control the rotation speed thereof. In the present embodiment, the rotation control section 33 controls the rotation speed of the driving motors to satisfy $0.99 \leqq V2/V1 < 1$, where V1 is the moving speed of the intermediate transfer belt 7 at the transfer nip positions (where the photosensitive drums 3*a* to 3*d* abut against the intermediate transfer belt 7) and V2 is the moving speed of the photoreceptor drums 3*a* to 3*d* at the transfer nip position. More specifically, in the present embodiment, the rotation speed of the driving motors are so controlled that peripheral speed (V1) of the intermediate transfer belt 7 is 134 mm/sec, and peripheral speeds (V2) of the photosensitive drums 3*a* to 3*d* are not slower than 132.66 mm/sec but faster than 134 mm/sec.

Figure 4:
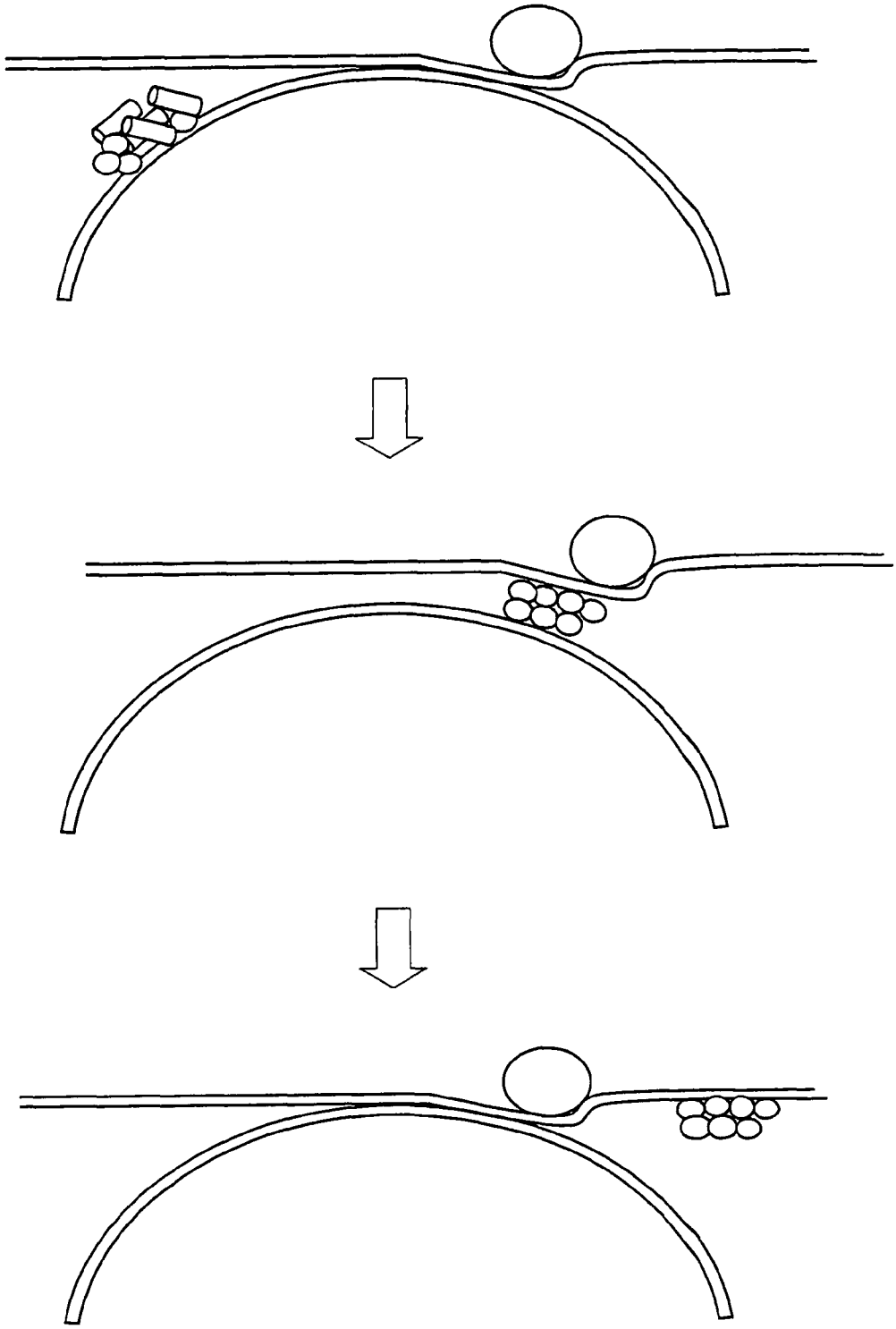
FIG. 4 is an explanatory view schematically illustrating how a toner image is transferred from the photosensitive drum to the intermediate belt in forming a monochromatic image in the image forming apparatus.

FIG. 4 is an explanatory view schematically illustrating how the toner image is transferred from the photoreceptor drum 3*a* to the intermediate transfer belt 7 in the arrangement in which the rotation speed of the driving motors are controlled to satisfy $0.99 \leqq V2/V1 < 1$, as in the present embodiment. FIG. 4 illustrates formation of a monochrome image (in this case, the photosensitive drum 3*a* is solely in touch with the intermediate transfer belt 7 while the other photosensitive drums 3*b* to 3*d* are detached from the intermediate transfer belt 7).

The peripheral speeds of the photosensitive drum 3*a* and that of the intermediate transfer belt 7 are different. This causes rubbing force between the photosensitive drum 3*a* and the intermediate transfer belt 7 at the transfer nip position. The rubbing force generates a mechanical energy that aligns the longitudinal direction the circular columnar toner along a width direction (main scanning direction) of the photosensitive drum 3*a* without causing image defects such as toner scattering, dot scattering, an increases in retransfer.

With this, the toner particles can be attached with each other with a wider contact area. This prevents or reduces the toner scattering. Moreover, this eliminates or reduces the gap between the toner particles that contribute to the image formation. The prevention or reduction of the toner scatting and the elimination or reduction of the gap between the toner particles prevents inconsistency of density in the fixed image.

Figure 5:
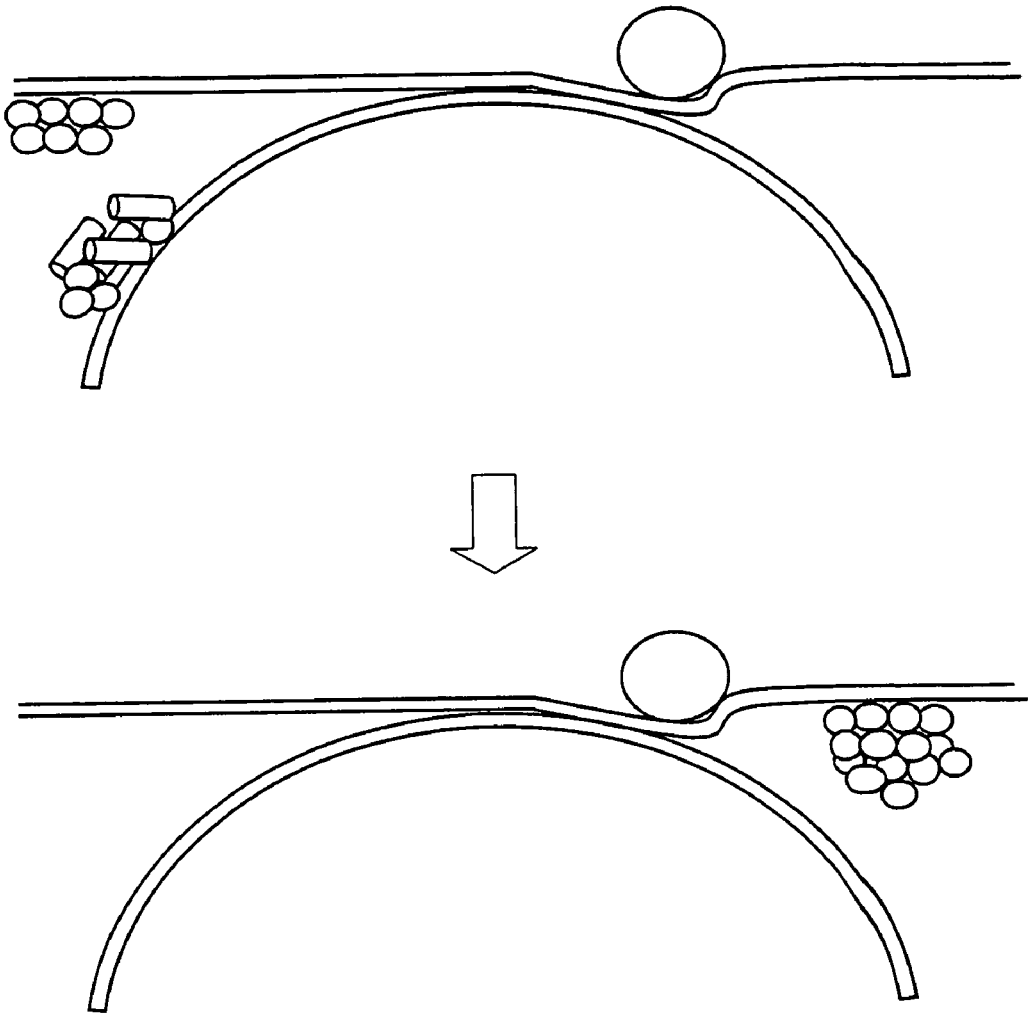
FIG. 5 is an explanatory view schematically illustrating how a toner image is transferred from the photosensitive drum to the intermediate belt in forming a multicolor image in the image forming apparatus.

FIG. 5 is an explanatory view schematically illustrating how the toner image is transferred from the photoreceptor drums 3*a* to 3*c* (which are for second to fourth colors) to the intermediate transfer belt 7 in the arrangement in which the rotation speed of the driving motors are controlled to satisfy $0.99 \leqq V2/V1 < 1$, as in the present embodiment. FIG. 5 illustrates formation of a multicolor image (in this case, the photosensitive drums 3*a* to 3*d* are in touch with the intermediate transfer belt 7).

As illustrated in FIG. 5, the superimposing of the toner images on the intermediate transfer belt 7 can be performed with a greater coagulation force of the toner particles which are attached with each other with such a greater contact area. Thus, in addition to the advantages in preventing the toner scattering and reducing the inconsistency of density, it its possible to prevent the retransfer in superimposing the toner image in any of second to fourth colors onto the toner image transferred on the intermediate transfer belt 7. The retransfer is a phenomenon in which the toner is transferred from image transfer body. The prevention of the retransfer makes it possible to superimpose the toner images on each other for the multicolor toner images appropriately.

As described above, the image forming apparatus according to the present embodiment is configured such that a visualized image on the photosensitive drum is developed with the circular columnar toner and the developed toner image is transferred from the photosensitive drum to the intermediate transfer belt, wherein a moving speed of the photosensitive drum and that of the intermediate transfer belt are different from each other at a contact position (transfer nip position) between the photosensitive drum and the intermediate transfer belt. With this configuration, the longitudinal direction of the circular columnar toner can be oriented along the main scanning direction by the sliding friction caused between the photosensitive drum and the intermediate belt. Consequently, it becomes possible to allow the toner particles to attach with each other with a wider contact area, which prevents or reduces the toner scattering. Moreover, this can prevent or reduce inconsistency of density in the fixed image.

Moreover, in the present embodiment, the toner image is firstly transferred to the intermediate transfer belt 7 that acts as the image transfer body. Then, the toner image is moved to a transfer position to which it is to be transferred on the recording sheet, and then transferred to the recording sheet. The present technology, however, is not limited to this. For example, the toner images on the photosensitive drums 3*a* to 3*d* may be directly transferred to the recording sheet that acts as the image transfer body.

Figure 6:
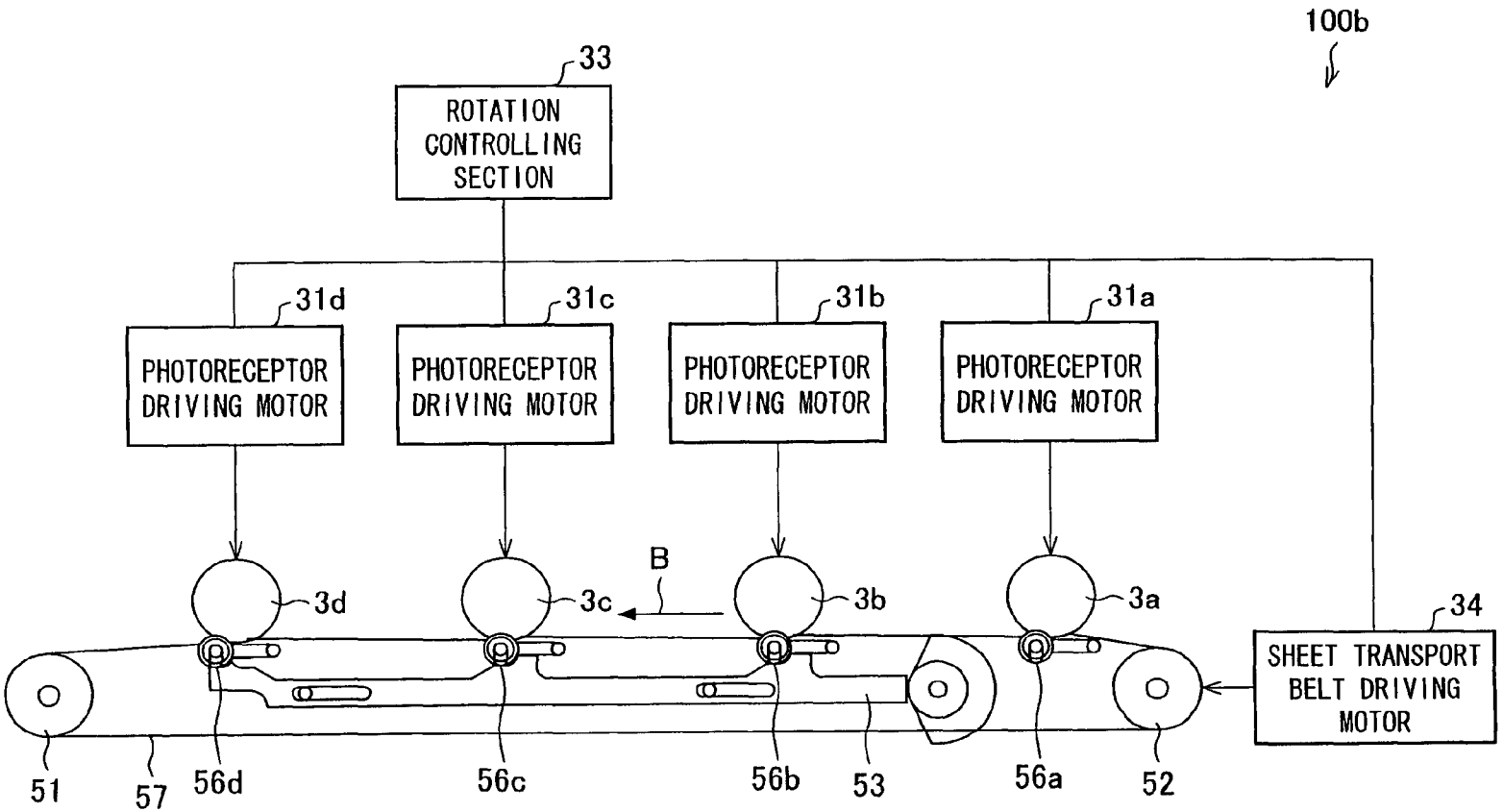
FIG. 6 is a cross sectional view illustrating a modification of the image forming apparatus.
Figure 7:
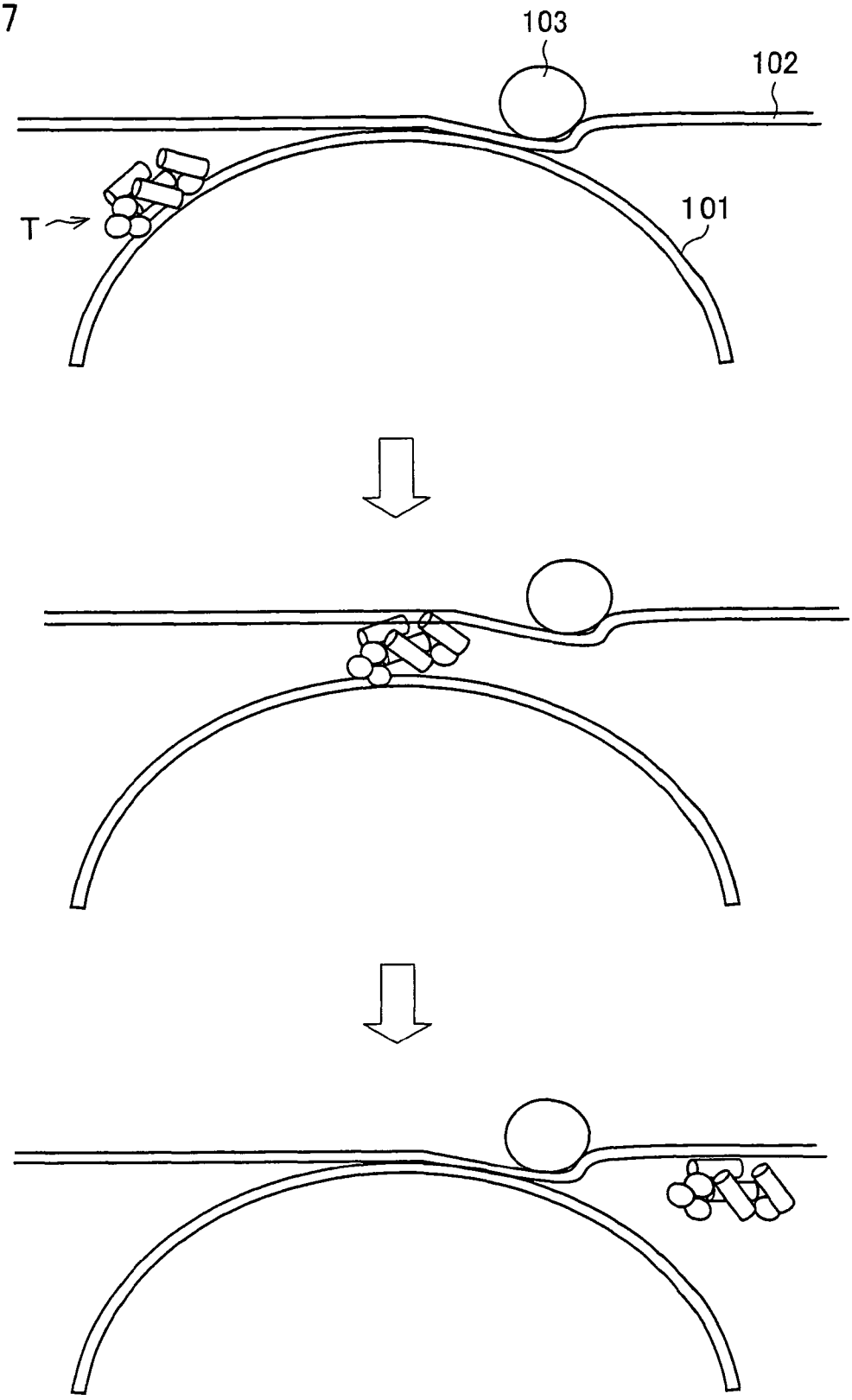
FIG. 7 is an explanatory view schematically illustrating how a toner image is transferred from the photosensitive drum to the intermediate in a conventional image forming apparatus using columnar toner.

FIG. 6 is an explanatory view illustrating a structure of an image forming apparatus 100*b* in which a toner image is directly transferred from a photosensitive drum to a recording sheet P. For the sake of easy explanation, members having the same functions as those in the image forming apparatus 100 are labeled in the same manner and their explanation is omitted here.

The image forming apparatus 100*b* illustrated in FIG. 6 includes transfer rollers 56*a* to 56*d*, a sheet transport belt 57, a sheet transport belt driving rollers 56*a* to 56*d*, a sheet transport belt 57, a sheet transport belt driving roller 51, a sheet transport belt driven belt roller 52, and a sheet transport belt tension mechanism 53, in replacement of the intermediate transfer roller 6*a* to 6*d*, the intermediate transfer belt 7, the intermediate belt driven roller 71, the intermediate transfer belt driven roller 72, and the intermediate transfer belt tension mechanism 73 of the image forming apparatus 100.

The sheet transport belt 57 conveys the recording sheet P by electrostatically holding the recording sheet P. Toner images formed on photosensitive drums 3*a* to 3*d* in the respective colors are transferred on the recording sheet, superimposing each other thereon. Moreover, the sheet transport belt 57 can be detached from the photosensitive drums 3*b* to 3*d*. That is, by shifting relative positions of the transfer rollers 56*b* to 56*d*, the sheet transport belt driving roller 51, the sheet transport belt driven roller 52, the sheet transport belt tension mechanism 53, and the like by driving means (not illustrated), the sheet transport belt 57 can be detached from the photosensitive drums 3*b* to 3*d*. This is to perform the monochromatic printing with the photosensitive drum 3*a* of black (k) solely touched with sheet transport belt 57 (or the recording sheet P).

The transfer of the toner images from the photosensitive drums 3*a* to 3*d* to the recording sheet P is carried out by the transfer rollers 56*a* to 56*d* that are in contact with the sheet transport belt 57 from its reverse side. The transfer rollers 56*a* to 56*d* are rotatably supported by transfer roller mounting sections (not illustrated) of the sheet transport belt tension mechanism 53. The transfer rollers 56*a* to 56*d* apply a high-voltage transfer bias on the sheet transport belt 57, thereby to transfer the toner images from the photosensitive drums 3*a* to 3*d* to the sheet transport belt 57 respectively. The transfer bias is a high voltage of the opposite polarity (+) to the electrification polarity (−) of the toner. Each of the transfer rollers 56*a* to 56*d* is positioned to abut against the corresponding photosensitive drum 3*a* to 3*d* with the sheet transport belt 57 therebetween. The abutting position of the transfer rollers 56*a* to 56*d* are located respectively in the downstream of an intersection of each corresponding photosensitive drum with a tangent line of the photosensitive drum, which is parallel to the moving direction of the sheet transport belt 57 (moving direction of the recording sheet P) at the transfer nip position.

In this configuration in which the toner images are transferred from the photoreceptor drums 3*a* to 3*d* to the recording sheet P directly, the peripheral speeds of the photoreceptor drums 3*a* to 3*d* and that of the image transfer body (i.e., the recording sheet P) are different from each other. Thereby, this configuration attains the substantially same effect as in the configuration in which the intermediate transfer belt 7 is provided and the peripheral speeds of the photosensitive drums 3*a* to 3*d* and that of the image transfer body (i.e., the intermediate transfer belt 7) are different.

Moreover, in the present embodiment, the image transfer body (the intermediate transfer body or the sheet transfer belt 7*b*) has a peripheral speed faster than those of the photosensitive drums 3*a* to 3*d*. The present technology, however, is not limited to this: the image transfer body (the intermediate transfer body or the sheet transfer belt 7*b*) may have a peripheral speed slower than those of the photosensitive drums 3*a* to 3*d*. This arrangement can align the longitudinal direction of the columnar toner that is to be transferred onto the image transfer body, thereby reducing the inconsistency of density and prevent scattering of dots. In the case where the image transfer body has a peripheral speed slower than those of the photosensitive drums 3*a* to 3*d*, the surface of the photosensitive drums 3*a* to 3*d* may wipe off the toner from the surface of the member to which the toner is transferred. This phenomenon is called wiping phenomenon. This would cause failure in transferring the toner images. Thus, it is more preferable that the image transfer body have a peripheral speed faster than those of the photosensitive drums 3*a* to 3*d*. If the failure in transferring the toner images was caused by the wiping phenomenon, this would likely cause partial blank of a line or a character. With the arrangement in which the image transfer body has a peripheral speed faster than those of the photosensitive drums 3*a* to 3*d*, it is possible to prevent the failure in transferring due to such partial blank.

Moreover, in the present embodiment, each of the intermediate transfer rollers 6*a* to 6*d* is positioned to abut against the corresponding photosensitive drum 3*a* to 3*d* with the intermediate transfer belt 7 therebetween in the downstream of an intersection of the corresponding photosensitive drum with a tangent line of the photosensitive drum, which is parallel to the moving direction of the intermediate transfer belt 7 at the transfer nip position. As an alternative, each of the transfer rollers 56*a* to 56*d* is positioned to abut against the corresponding photosensitive drum 3*a* to 3*d* with the sheet transport belt 57 therebetween in the downstream of an intersection of the corresponding photosensitive drum with a tangent line of the photosensitive drum, which is parallel to the moving direction of the sheet transport belt 57 at the transfer nip position.

This arrangement makes it possible to have a sufficient transfer nip (abutting width between the image transfer body (the intermediate transfer belt 7 or the recording sheet P) and the photosensitive drums 3*a* to 3*d*). As a result, it is possible to improve the transfer efficiency. Moreover, it is possible to reduce such a case that the toner is scattered from the toner image before the toner image goes into the transfer nip.

The present embodiment uses the circular columnar toner having a L/R ration of not less than 1.75 but not more than 3.63 where L is the length of the toner particle in its longitudinal direction and r is a radium of the sphere whose volume is equal to the toner particle. The use of the circular columnar toner satisfying the above condition together with the configuration in which the peripheral speeds of the photosensitive drums 3*a* to 3*d* (moving speeds thereof at the transfer nip position) and that of the member (the intermediate transfer belt 7 or the recording sheet P) for receiving the toner images are different from each other makes it possible to orient the longitudinal directions of the circular columnar toner particles along the main scanning direction accurately. This is more effective to prevent the toner from scattering and to reduce the inconsistency of density. For higher accuracy in orienting the longitudinal direction of the circular columnar toner along the main scanning direction, it is preferable that the circular columnar toner have a L/R to satisfy 2.19<L/R 3.63, in other words, it is preferable that the circular columnar toner have a L/D to satisfy 1.4<L/R≦3. Moreover, use of cylinder toner whose L/R is not less than 1.75 but not more than 3.63 makes it possible to prevent the toner scattering and the inconsistency of density, even if the cylinder toner has a cross sectional shape of imperfect circle in the vertical direction to its axis. Moreover, the use of cylinder toner whose L/R to satisfy 2.19<L/R 3.63 makes it possible to prevent the toner scattering and the inconsistency of density to a greater extent. In order that the longitudinal directions of the toner particles to be transferred may be aligned more certainly, it is preferable that the toner particle have a circular cross section or a substantially circular cross section along the vertical direction to its axis.

Embodiment 2

Another embodiment is described below. For the sake of easy explanation, members having the same functions as those in the Embodiment 1 are labeled in the same manner and their explanation is omitted here.

Figure 8:
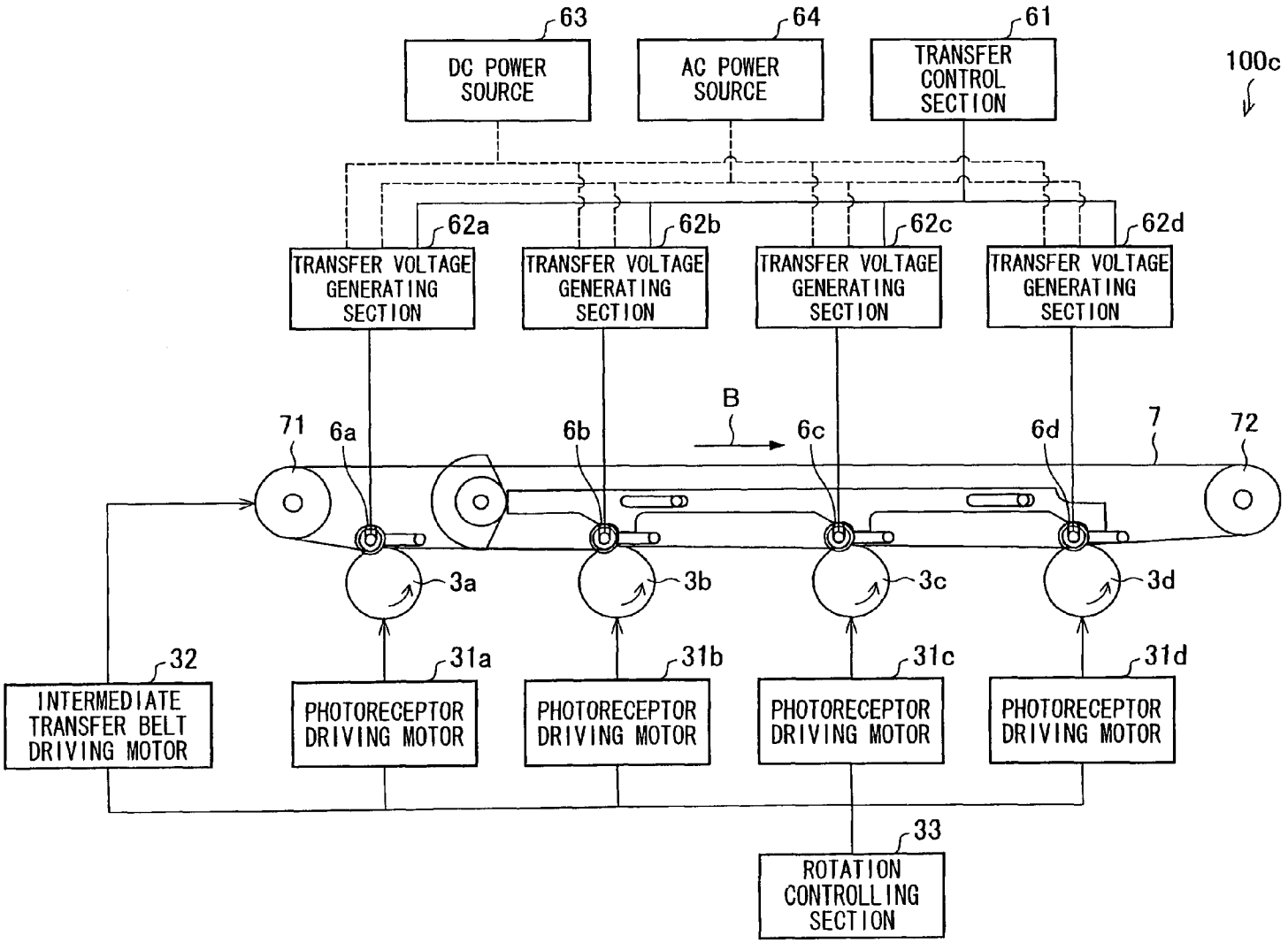
FIG. 8 is an explanatory view schematically illustrating a structure of an image forming apparatus.

FIG. 8 is an explanatory view illustrating a structure of an image forming apparatus 100*c* according to the present embodiment. As illustrated in FIG. 8, the image forming apparatus 100*c* has the same configuration as the image forming apparatus 100 (see FIG. 2) in Embodiment 1 and further includes a transfer control section 61, transfer voltage generating section 62*a* to 62*d*, a DC (direct current) power source 63, and an AC (alternating current) power source 64.

The DC power source 63 supplies a DC potential to the transfer voltage generating sections 62*a* and 62*b*. The AC power source 64 supplies an AC potential to the transfer voltage generating sections 62*a* and 62*b*.

The transfer voltage generating sections 62*a* to 62*d* respectively generate transfer voltages (transfer bias voltages) to be applied between the intermediate transfer rollers (transfer members) 6*a* to 6*d* and the photosensitive drums 3*a* to 3*d*.

The transfer control section 61 controls the operations of the transfer voltage generating sections 62*a* to 62*d*, thereby to control the transfer voltage to desired voltages, which are to be applied between the intermediate rollers (transfer members) 6*a* to 6*d* and the photosensitive drums 3*a* to 3*d*.

More specifically, according to the control signals from the transfer control section 61, the transfer voltage generating sections 62*a* to 62*d* generate the transfer potentials of predetermined levels by mixing the direct current potentials (supplied from the DC power source 63) and the alternating current potentials (supplied from the AC power source 64) after appropriately amplifying the direct and alternating current potentials. Then, the transfer voltage generating sections 62*a* to 62*d* supply the transfer potentials to the intermediate transfer rollers 6*a* to 6*d*, respectively. Thereby, the transfer voltages of the predetermined levels in which the direct current voltages (DC bias voltage) and the alternating current voltages (AC bias voltage) are mixed are applied to between the intermediate transfer rollers 6*a* to 6*d* and the photosensitive drums 3*a* to 3*d*.

In the present embodiment, the transfer voltages applied between the intermediate transfer rollers 6*a* to 6*d* and the photosensitive drums 3*a* to 3*d* are not lower than 2000V but not higher than 3300V. Moreover, the alternative potentials as one component of the transfer potentials have peak-to-peak voltage (a difference between the maximum potential and the minimum potential thereof) is not lower than 500V but not higher than 1200V. Furthermore, the alternative potentials as one component of the transfer potentials have frequencies not lower than 1000 Hz but not higher than 2500 Hz.

The following explain reasons why the voltage of the transfer potentials, the peak-to-peak voltage of the alternating current potentials, and the frequency of the alternating current potential are set as above.

Table 1 shows results of measurements of the transfer efficiency of the columnar toner in case where only the DC bias voltage (direct current voltage) is applied between the intermediate transfer rollers 6*a* to 6*d* and the photosensitive drums 3*a* to 3*d*, where the process speed (peripheral speed of each photosensitive drum 3*a* to 3*d* at the transfer nip (where the intermediate transfer belt 7 and each photosensitive drum 3*a* to 3*d* are in contact) was 134 mm/sec, an amount of toner attached to the photosensitive drums 3*a* to 3*d* was 0.45 mg/cm$^2$. Moreover, the transfer efficiency was worked out by dividing an amount of toner attached to the intermediate transfer belt by the amount of the toner attached to the photosensitive drums 3*a* to 3*d*, where the amount of the toner attached to the photosensitive drums 3*a* to 3*d* was measured before the transfer operation to form an all-painted image and the amount of toner attached to the intermediate transfer belt 7 was measured right after the transfer operation.

TABLE 1

| AV (V) | 1500 | 1800 | 2000 | 2200 | 2500 | 2800 | 3000 | 3300 | 3500 | 3800 | 4000 |
|---|---|---|---|---|---|---|---|---|---|---|---|
| TE (%) | 70 | 77 | 85 | 88 | 95 | 96 | 93 | 90 | 72 | 60 | 50 |

Note:

AV stands for Applied Voltage.

TE stands for Transfer Efficiency.

To attain practically acceptable image quality, the transfer efficiency of 80% or more is preferable. Therefore, from the results of the experiment shown in Table 1, it is preferable that the transfer voltage applied between the intermediate transfer rollers 6*a* to 6*d* and the photosensitive drums 3*a* to 3*d* be not lower than 2000V but not higher than 3300V.

Moreover, as illustrated in Table 1, the transfer voltage higher than 3300V (3500V or higher) caused significantly low transfer efficiency. It was considered that an excessively large transfer voltage causes an electrical discharge between the intermediate transfer belt 7 and the toner images on the photosensitive drums 3*a* to 3*d*, thereby deteriorating an effective electric field that contributes the transfer. It is considered that the low transfer efficiency with the transfer voltages of lower than 2000V was caused because the electric field at the transfer nip between each intermediate transfer roller 6*a* to 6*d* and the photosensitive drum 3*a* to 3*d* is insufficient in strength.

The numbers 1 to 5 indicates the levels of the image quality (reproducibility of line images, reproducibility of dots, etc.) of the image formed on the recording sheets.

5: No Failure in Image

4: Some Invisible Failures in Image (Practically Acceptable)

3: Many Invisible Failures in Image (Practically Acceptable)

2: Some Clearly Visible Failures in Image

1: Many Clearly Visible Failures in Image

TABLE 2

| Frequency | Vp-p(V) | | | | | |
|---|---|---|---|---|---|---|
| (Hz) | 300 | 500 | 700 | 1000 | 1200 | 1500 |
| 400 | 1 | 1 | 1 | 1 | 1 | 1 |
| 600 | 1 | 1 | 1 | 1 | 1 | 1 |
| 800 | 1 | 2 | 2 | 3 | 3 | 2 |
| 1000 | 2 | 3 | 3 | 4 | 4 | 2 |
| 1500 | 2 | 3 | 4 | 5 | 4 | 2 |
| 2000 | 2 | 3 | 5 | 5 | 4 | 2 |
| 2200 | 2 | 3 | 4 | 4 | 4 | 2 |
| 2500 | 1 | 3 | 3 | 3 | 3 | 2 |
| 2800 | 1 | 2 | 2 | 2 | 2 | 2 |
| 3000 | 1 | 1 | 1 | 1 | 1 | 1 |

From the experiment results, the transfer voltage of not lower than 2000V but not higher than 3300V is preferable. With a transfer voltage of lower than 2000V, the electric field will be insufficient in strength at the transfer nip, thereby deteriorating the transfer efficiency. With a transfer voltage of higher than 3300V, the electric discharge will occur at the transfer nip thereby deteriorating the effective electric field at the nip, resulting in poor transfer efficiency. On the other hand, the transfer voltage of not lower than 2000V but not higher than 3300V makes it possible to transfer the columnar toner without causing poor transfer efficiency and dot image deterioration due to toner scattering or the like.

Moreover, it was found that the alternating current potential to be mixed into the direct current voltage to form the transfer voltage preferably has a peak-to-peak voltage of not lower than 500V but not higher than 1200V, and a frequency of not less than 1000 Hz but not higher than 2500 Hz. With such an alternating current potential, it is possible to form a practically acceptable image on recording sheets.

As to the direct current voltage to be mixed into the alternating potential to form the transfer voltage, the direct current voltage should be such a voltage that gives the transfer voltage of not lower than 2000V but not higher than 3000V when it is mixed into the alternating current potential having the peak-to-peak voltage of not lower than 500V but not higher than 1200V. It is more preferable that the direct current voltage be not less than 2000V but not more than 3000V. The direct current voltage within the range makes it possible to transfer the columnar toner without causing poor transfer efficiency and dot image deterioration due to the toner scattering or the like. A direct current voltage of lower than 2000V leads to insufficient electric field at the transfer nip, thereby resulting in poor transfer efficiency. Moreover, a direct current voltage exceeding 3000V leads to electric discharge at the transfer nip, thereby deteriorating the effective electric field at the transfer nip. This results in poor transfer efficiency.

As described above, an image forming apparatus according to the present embodiment is arranged such that a moving speed of a photosensitive drum and that of an intermediate transfer belt are different from each other at a contact position (transfer nip section) where the photosensitive drum and the intermediate transfer belt are in contact with each other, and that a transfer voltage in which a direct current voltage is mixed into an alternating current voltage is applied to between the photosensitive drum and the intermediate transfer belt.

With this arrangement, a rubbing force can be caused between the photosensitive drum and the intermediate transfer belt, and the electric field caused by the transfer voltage appropriately reduces toner coagulation in the transfer nip. Consequently, the rubbing force can easily affect each toner particle, thereby to orient the direction of the toner. This makes it possible to surely orient the longitudinal direction of the circular columnar toner along the main scanning direction without causing image defects such as toner scattering, dot scattering, an increase in retransfer. Therefore, this arrangement realizes a wider contact area between toner particles, thereby more surely preventing or reducing the toner scattering. Moreover, this arrangement can eliminate (or reduce) the gap between the toner particles that contribute the image formation. Together with the prevention of the toner scattering, this surely prevents or reduces the inconsistency of density in the fixed image.

Especially, in case of a machine having a high process speed, the configuration of the image forming apparatus according to Embodiment 1 might be insufficient, in some cases, to orient the longitudinal directions (longer dimensional direction) of the columnar toner along the main scanning direction (direction at the right angle to the rotation direction accurately. The time for passing through the transfer nip is shortened due to the high processing speed. It is considered that the short time for passing through the transfer nip results in a short time to apply the rubbing force on the columnar toner.

On the other hand, the image forming apparatus according to the present embodiment performs the step of transferring the toner images from the photosensitive drums 3*a* to 3 to the intermediate transfer belt 7, wherein the transfer voltage in which the direct current voltage is mixed into the alternating current voltage is applied to between the photosensitive drums 3*a* to 3*d* and the intermediate transfer belt 7 so as to alleviate the toner coagulation in the transfer nip. This arrangement makes it possible to easily effect the rubbing force to the individual toner particles even if the time for effecting the rubbing force on the toner particles is short. As a result, this arrangement makes it possible to orient the longitudinal direction (longer dimensional direction) of the columnar toner along the main scanning direction (direction at the right angle to the rotating direction).

However, excessively low toner coagulation would lead to image quality deterioration such as the toner scattering, dot scattering, an increase in retransfer, etc. To attain adequately loose coagulation of the columnar toner, it is preferable that the peak-to-peak voltage of the alternating voltage be not lower than 500V but not higher than 1200V, and the frequency of alternating voltage be not lower than 1000 Hz but not higher than 2500 Hz (the frequency that causes a toner frequency of not less than 28.9 times but not more than 72.25 times in the transfer nip (each contact position between the photosensitive drums 3*a* to 3*d* and the intermediate transfer belt 7)) With this, it is possible to orient the longitudinal directions (longer dimensional direction) of the columnar toner along the main scanning direction (direction at the right angle to the rotation direction without causing image quality deterioration such as the toner scattering, dot scattering, an increase in retransfer, etc.

It is preferable that the transfer voltage be not lower than 2000V but not higher than 3300V. The transfer voltage of lower than 2000V leads to poor transfer efficiency due to insufficient electric field strength at the transfer nip. Moreover, the transfer voltage of higher than 3300V causes electric discharge in the transfer nip, which results in lower effective electric field at the transfer nip. This also results in poor transfer efficiency. On the other hand, the transfer voltage of not lower than 2000V but not higher than 3300V prevent the poor transfer efficiency (thereby keeping the transfer efficiency of 80% or higher) and allows the transfer of the columnar toner without causing the poor quality of dot image due to the toner scattering.

In an arrangement in which the toner images are transferred from the photosensitive drums 3*a* to 3*d* to the recording sheet P directly, as in the image forming apparatus 100*b* illustrated in FIG. 6, it may be arranged such that the peripheral speeds of the photosensitive drums 3*a* to 3*d* and the moving speed of the image transfer body (recording sheet P) are different and the transfer bias in which the direct current bias is mixed into the alternating current bias is applied.

With this arrangement, this attains substantially similar effect to that in the arrangement in which the intermediate transfer belt 7 is provided, wherein the peripheral speeds of the photosensitive drums 3*a* to 3*d* and the moving speed of the image transfer body (the intermediate transfer belt 7) are different and the transfer bias in which the direct current bias is mixed into the alternating current bias is applied.

As described above, the present technology includes: an image bearing member; first driving means for rotating the image bearing member; electrical charging means for electrically charging the image bearing member; latent image forming means for forming an electrostatic latent image on the electrically charged image bearing member; developing means for developing the latent image formed on the image bearing member, to form a toner image with columnar toner whose shape is stretched in one direction; second driving means for effecting relative movement of an image transfer body with respect to the image bearing member; and transfer means for transferring the toner image from the image bearing member to the image transfer body by contacting the image bearing member with the image transfer body, the image bearing member and the image transfer body having different moving speeds at a contact position where they are in contact with each other.

With this arrangement, in which the image bearing member and the image transfer body have different moving speeds at a contact position where they are in contact with each other, a rubbing force is caused between the image bearing member and the image transfer body. The rubbing force orients longitudinal directions of particles of the columnar toner along the main scanning direction (a direction vertical to a rotation direction). This allows the toner particles to attach with each other with a greater contact area, thereby attaining a greater coagulation between the toner particles. This prevents the toner scattering. Moreover, this prevents gap formation between the toner particles. This prevents density inconsistency in a transferred toner image.

The use of the columnar toner provides (a) stable image density, (b) better control over color density (gradation), (c) higher resolution, (d) prevention of photographic fog and or prevention of dusts (dots in white space) in transferring, (e) prevention of filming a developing roller or photoreceptor with toner particles, and the other effects.

The image transfer body may be a recording medium in a sheet shape, or an intermediate transfer body, to which the toner image is transferred from the image bearing member and from which the toner image is transferred to a recording medium in a sheet-like shape. The recording medium in a sheet shape may be a thin-film recording medium such as paper or a transparent film, for example.

The transfer means may include: a transfer member facing against the image transfer body; and voltage applying means for applying a transfer voltage made by mixing an alternating voltage into a direct voltage to between the image bearing member and the transfer member.

With this arrangement, a rubbing force can be caused between the photosensitive drum and the intermediate transfer belt, and the electric field caused by the transfer voltage appropriately reduces toner coagulation in the transfer nip. Consequently, the rubbing force can easily affect each toner particle, thereby to orient the direction of the toner. This makes it possible to surely orient the longitudinal direction of the circular columnar toner along the main scanning direction without causing image defects such as toner scattering, dot scattering, an increase in retransfer. Therefore, this arrangement realizes a wider contact area between toner particles, thereby more surely preventing or reducing the toner scattering. Moreover, this arrangement can eliminate (or reduce) the gap between the toner particles that contribute the image formation. Together with the prevention of the toner scattering, this surely prevents or reduces the inconsistency of density in the fixed image.

Moreover, the image forming apparatus may be arranged such that the alternative voltage is not lower than 500V and not higher than 1200V in the difference between the maximum potential and the minimum potential, and has a frequency not lower than 1000 Hz but not higher than 2500 Hz.

the image forming apparatus may be arranged such that the alternative voltage is not lower than 500V and not higher than 1200V in the difference between the maximum potential and the minimum potential, and has a frequency making the toner frequency not less than 28.9 times but not more than 72.25 times at the contact position between the image bearing member and the image transfer body.

With this arrangement, the longitudinal direction of the columnar toner can be oriented along the main scanning direction without causing image defect such as toner scattering, dot scattering, and an increase in retransfer.

The image forming apparatus may be arranged such that the transfer voltage is not lower than 2000V but not higher than 3300V.

This arrangement presents poor transfer efficiency and makes it possible to transfer the columnar toner without causing non-uniformity in dot image due to toner scattering or the like.

Moreover, the image forming apparatus may be arranged such that the transfer means includes an abutting member, which abuts against the image bearing member with the image transfer body therebetween, the image bearing member having a circular cylinder shape, the image transfer body moving along a tangent line direction of a circle shape of a cross section of the image bearing member, and the abutting member being located in a downstream of an intersection of the tangent line and the circle shape in the moving direction of the image transfer body.

With this arrangement, in which the abutting member is located in the downstream of the contact position of the tangent line and the circle shape in the moving direction of the image transfer body, the image bearing member and the image transfer body can contact with each other with a greater contact area at the contact position. This attains a wider area in which the rubbing force is produced between the image bearing member and the image transfer body. Therefore, the toner scattering prevention and the density inconsistency can be improved. Moreover, this improves the toner transfer efficiency.

Moreover, the image forming apparatus may be arranged such that at the contact position between the bearing member and the image transfer body, the moving speed of the image transfer body is faster than the moving speed of the image bearing member.

With this arrangement, in which at the contact position between the bearing member and the image transfer body, the moving speed of the image transfer body is faster than the moving speed of the image bearing member, it is possible to prevent wiping phenomenon. That is, the arrangement can prevent the surface of the image bearing member from wiping off the transferred toner from the image transfer body. This prevents transfer failure caused by the wiping phenomenon. If the failure in transferring the toner images was caused by the wiping phenomenon, this would likely cause partial blank of a line or a character. With the arrangement, it is possible to prevent the failure in transferring due to such partial blank.

The image forming apparatus may be arranged such that the columnar toner has an L/R ratio of not less than 1.75 but not more than 3.63, where L is a length of the columnar toner in the one direction, and R is a radius of a sphere whose volume is equal to that of the columnar toner.

With this arrangement, the longitudinal directions of the columnar toner particles transferred on the image transfer body can be oriented more surely. Therefore, the toner scattering prevention and the density inconsistency can be further improved. Moreover, this improves the toner transfer efficiency.

The columnar toner may have a substantially circular cross section in a direction vertical to the one direction. The "substantially circular" shape encompasses perfect circular shape and any shape that can be regarded as circular shape substantially. More specifically, the substantially circular shape is a shape that satisfies $L2/L1=1\pm0.2$ where L1 is a peripheral length of the cross section and L2 is a peripheral length of a circle whose area is equal to the cross section.

With this arrangement, in which a substantially circular cross section in the direction vertical to the one direction, the longitudinal directions of the columnar toner particles transferred on the image transfer body can be oriented more surely. Therefore, the toner scattering prevention and the density inconsistency can be further improved. Moreover, this improves the toner transfer efficiency.

Moreover, the image forming apparatus may comprise a plurality of the image bearing members, wherein the plurality of the image bearing members each transfers an image to the image transfer body, so that a plurality of color images are overlapped on the image transfer body.

With this arrangement, the longitudinal directions of the toner particles transferred from the image bearing member to the image transfer body can be oriented. Thereby, the toner particles can be attached with each other with a wider contact area thereby having a higher coagulation force therebetween. In addition to the prevention of the toner scattering of the toner transferred from the image bearing member to the image transfer body and the reduction of the density inconsistency, this prevents the phenomenon in which the toner is carried from the image transfer body to the image bearing member when superimposing the toner image (of the second color or later color) on the other toner image on the image transfer body, or the phenomenon in which the toner to be transferred from the image bearing member to the image transfer body is remained on the image bearing member. Consequently, this arrangement makes it possible to perform the superimposing of images in plural colors with good quality. This prevents color inconsistency in the image after the transfer of toner images in the plural colors.

The present technology is not limited to the description of the embodiments above, but may be altered by a skilled person within the scope of the claims. An embodiment based on a proper combination of technical means disclosed in different embodiments is encompassed in the technical scope of the present technology.

The embodiments and concrete examples of implementation discussed in the foregoing detailed explanation serve solely to illustrate the technical details of the present technology, which should not be narrowly interpreted within the limits of such embodiments and concrete examples, but rather may be applied in many variations within the spirit of the present technology, provided such variations do not exceed the scope of the patent claims set forth below.

What is claimed is:

1. An image forming apparatus, comprising:

an image bearing member;

first driving means for rotating the image bearing member;

electrical charging means for electrically charging the image bearing member;

latent image forming means for forming an electrostatic latent image on the electrically charged image bearing member;

developing means for developing the latent image formed on the image bearing member, to form a toner image with columnar toner particles whose shape is stretched in one direction;

second driving means for effecting relative movement of an image transfer body with respect to the image bearing member; and transfer means for transferring the toner image from the image bearing member to the image transfer body by contacting the image bearing member with the image transfer body, the image bearing member and the image transfer body having different moving speeds at a contact position where they are in contact with each other, wherein the different moving speeds of the image bearing member and the image transfer body at the contact position cause a rubbing action between the image bearing member and the image transfer body, and wherein the rubbing action causes the cylindrical toner particles to align with one another along their respective longitudinal axes, and wherein the transfer means comprises:

a transfer member that bears against the image transfer body; and voltage applying means for generating a transfer voltage made by mixing an alternating current voltage and a direct current voltage, and for applying the transfer voltage between the image bearing member and the transfer member.

2. The image forming apparatus as set forth in claim 1, wherein the alternating current voltage is not lower than 500V and not higher than 1200V in the difference between the maximum potential and the minimum potential, and has a frequency not lower than 1000 Hz but not higher than 2500 Hz.

3. The image forming apparatus as set forth in claim 1, wherein the alternating current voltage is not lower than 500V and not higher than 1200V in the difference between the maximum potential and the minimum potential, and has a frequency making the toner frequency not less than 28.9 times but not more than 72.25 times at the contact position between the image bearing member and the image transfer body.

4. The image forming apparatus as set forth in claim 1, wherein the transfer voltage is not lower than 2000V but not higher than 3300V.

5. The image forming apparatus as set forth in claim 1, wherein the image transfer body is a recording medium in a sheet-like shape.

6. The image forming apparatus as set forth in claim 1, wherein the image transfer body is an intermediate transfer body to which the toner image is transferred from the image bearing member and from which the toner image is transferred to a recording medium in a sheet-like shape.

7. The image forming apparatus as set forth in claim 1, wherein the image bearing member has a cylindrical shape, the image transfer body moves along a tangent line direction of the cylindrical shaped image bearing member, and the transfer member is located downstream of the contact position in the moving direction of the image transfer body.

8. The image forming apparatus as set forth in claim 1 wherein at the contact position between the image bearing member and the image transfer body, the moving speed of the image transfer body is faster than the moving speed of the image bearing member.

9. The image forming apparatus as set forth in claim 1 wherein the columnar toner particles have an L/R ratio of not less than 1.75 but not more than 3.63, where L is a length of the columnar toner particles in the one direction, and R is a radius of a sphere whose volume is equal to that of the columnar toner particles.

10. The image forming apparatus as set forth in claim 1 wherein the columnar toner particles have a substantially circular cross section in a direction perpendicular to the one direction.

11. The image forming apparatus as set forth in claim 1, wherein the image bearing member comprises a plurality of the image bearing members, wherein the plurality of the image bearing members each transfers a different color toner image to the image transfer body, so that a plurality of color images are overlapped on the image transfer body.

12. The image forming apparatus as set forth in claim 1, wherein the alignment of the toner particles caused by the rubbing action between the image bearing member and the image transfer body increases an amount of contact area between abutting toner particles.

13. The image forming apparatus as set forth in claim 1, wherein the alignment of the toner particles caused by the rubbing action between the image bearing member and the image transfer body increases an adherence force between the toner particles.

14. The image forming apparatus as set forth in claim 1, wherein when the developing means deposits the cylindrical toner particles of a toner image on the image bearing member such that they have random orientations with respect to one another, with gaps formed between adjacent toner particles because of the random orientations, and wherein the alignment of the toner particles reduces the number of gaps between adjacent toner particles relative to the number of gaps that were present when the toner particles were located on the image bearing member.

* * * * *